US006848674B2

(12) United States Patent
Lee

(10) Patent No.: US 6,848,674 B2
(45) Date of Patent: Feb. 1, 2005

(54) PLACEMENTING METHOD OF REINFORCING STRIPS FOR CONSTRUCTING PRECAST CONCRETE FACING PANEL AND PULLING-UP DEVICE OF REINFORCING STRIPS

(76) Inventor: Jeung Su Lee, 7-208 Samsung Apartment Sanbon-Dong, Kunpo, Kyungki-Do (KR), 435-740

( * ) Notice: Subject to any disclaimer, the term of this patent is extended or adjusted under 35 U.S.C. 154(b) by 0 days.

(21) Appl. No.: 10/416,033

(22) PCT Filed: Sep. 28, 2001

(86) PCT No.: PCT/KR01/01632

§ 371 (c)(1),
(2), (4) Date: May 7, 2003

(87) PCT Pub. No.: WO02/38872

PCT Pub. Date: May 16, 2002

(65) Prior Publication Data

US 2004/0025315 A1 Feb. 12, 2004

(30) Foreign Application Priority Data

Nov. 8, 2000 (KR) ..... 2000-31205 U
Dec. 8, 2000 (KR) ..... 2000-34463 U
Apr. 27, 2001 (KR) ..... 2001-22866

(51) Int. Cl.[7] ..... B66F 3/00

(52) U.S. Cl. ..... 254/262; 254/263; 52/749.1; 52/DIG. 1

(58) Field of Search ..... 52/749.11, 749.12, 52/749.13, 749.14, DIG. 1, 749.1; 254/262, 263; 29/281.5

(56) References Cited

U.S. PATENT DOCUMENTS 832,337 A * 10/1906 Neel ..... 254/262
1,062,939 A * 5/1913 White ..... 254/263
2,796,233 A * 6/1957 Taft ..... 254/228
5,451,120 A 9/1995 Martinez-Gonzalez
6,050,748 A 4/2000 Anderson et al.
2003/0230208 A1 * 12/2003 Mietta ..... 101/408

FOREIGN PATENT DOCUMENTS

| | | |
|---|---|---|
| JP | 7-90863 | 4/1995 |
| JP | 9-242096 | 9/1997 |
| KR | 1999-64846 | 8/1999 |
| KR | 2000-12630 | 3/2000 |

* cited by examiner

*Primary Examiner*—Carl D. Friedman
*Assistant Examiner*—Chi Q. Nguyen
(74) *Attorney, Agent, or Firm*—Staas & Halsey LLP

(57) ABSTRACT

In a method of supporting a facing panel by zigzag-connecting synthetic resin reinforcing strips between fixing hookers formed on the interior surface of a concrete facing panel and a fixing iron bar fixed at the rear of a reinforcing soil member by means of an anchor, and burying the reinforcing strips into the reinforcing soil member at the rear of the concrete facing panel, a reinforcing strip placement method wherein a pulling-up device is locked between a rear end of the reinforcing strips and the fixing iron bar fixed by means of the anchor and pulled sequentially from one end to the other end of each of the reinforcing strips zigzag-connected between the concrete facing panel and the fixing iron bar, thereby preventing loosening of the reinforcing strips and applying a constant tension thereto, and then the reinforcing soil member is laid on the resultant structure and hardened by applying vibration and pressure thereto. Also, the reinforcing strip placement method can be performed more easily and faster with reduced labor force.

12 Claims, 13 Drawing Sheets

PLACEMENTING METHOD OF REINFORCING STRIPS FOR CONSTRUCTING PRECAST CONCRETE FACING PANEL AND PULLING-UP DEVICE OF REINFORCING STRIPS

TECHNICAL FIELD

The present invention relates to a placement method of reinforcing strips for constructing a precast concrete facing panel and a pulling-up device of reinforcing strips, and more particularly, to a placement method and device which can prevent deformation of a concrete facing panel (also referred to as a concrete retaining wall) from occurring after completing the placement by pulling-up synthetic resin reinforcing strips having strip fabrics incorporated in tiers at regular spacing with a constant tension so as not to be loosened, and which can greatly reduce labor force and time required for placing the same.

BACKGROUND ART

In general, a method of placing reinforcing strips for constructing a precast concrete facing panel using reinforcing strips made of construction fabrics (called a "WEBSOL" technique) is performed by steps of placing and curing base concrete at level on the ground where a facing panel is to be installed to a depth of 20 cm and a width of 40 to 50 cm, installing a prop before mounting reinforcing strips made of fabrics for the purpose of preventing deformation which may arise when a concrete facing panel (retaining wall) is mounted on the base concrete and backfill soil is hardened, installing a clamp between panels for the purpose of preventing deformation which may arise when a concrete facing panel (retaining wall) is mounted on the base concrete and backfill soil is hardened and then inserting a vertical batten filler made of construction fabrics for use in highly water-permeable filter for drainage from the backfill soil, installing a key-wood on a joint of the front face of the concrete facing panel to a predetermined height until the processes of forming retaining soil to a predetermined height and hardening the same are completed, for the purposes of maintaining linearity of the installed concrete facing panel and preventing deformation thereof, connecting the reinforcing fabrics to a fixed reinforcing iron bar provided at the rear portion fixed by a fixing hook buried into the internal side of the facing panel and an anchor in a zigzag pattern and pulling up the same manually, laying a backfill material on the reinforcing strip and applying vibration and pressure to the resultant structure to have a predetermined thickness using a heavy equipment for hardening the resultant structure, and repeating the hardening step until approximately 2 m upward from the facing panel is reached using a small-sized hardening equipment while piling up the facing panel.

The conventional method of constructing a precast concrete facing panel poses various problems and difficulties in terms of working efficiency. That is to say, at least 4 to 5 worker must be involved in interconnecting the reinforcing strips between the interior surface of the facing panel and the fixed reinforcing iron bar in a zigzag pattern. In detail, manually pulling-up the reinforcing strips requires 2 or 3 workers, pressing the reinforcing strips at a bent portion at the fixing hook of the facing panel side requires at least one worker, and inducing the reinforcing strips reversed at the fixing iron bar and pulling up the same requires at least one worker. However, in the case where the length of each of the reinforcing strips to be constructed is increased as per specification, at least 7 to 8 workers are required. In particular, the worker in charge of the pulling-up work experiences physical fatigue and lowered working efficiency because the reinforcing strip is too wide and high for the worker to be pulled up by hand, e.g. as wide as approximately 10 cm. Also, it is quite difficult to pull up the reinforcing strips with a constant tension, resulting in a deformed facing panel, that is, a potbellied or twisted facing panel, after completing the placement, due to the loosened reinforcing strips remaining on the reinforcing soil member.

Several attempts to prevent the reinforcing strips from being loosened have been made, including a method of laying a reinforcing soil member using a heavy equipment in a state in which the reinforcing strips are forcibly pulled up such that a worker locks a lever in front of a fixing iron bar to be pushed away rearward, and a method of partially digging reinforcing strips and laying a reinforcing soil member thereon so that the reinforcing strips are pulled up while the dig portion of the reinforcing strips is buried. However, these methods are not so effective in preventing the reinforcing strips from being loosened and for applying an appropriate tension to the reinforcing strips. That is, since a most severely loosened portion of the reinforcing strips connected between the concrete facing panel and the fixing iron bar correspond to bent portions of the fixing hook at the interior surface of the concrete and the fixing iron bar at the rear end of the reinforcing soil member, the loosening of these portions cannot be effectively eased by the above-reference methods.

DISCLOSURE OF THE INVENTION

The present invention is proposed to overcome the disadvantages discussed above relating to conventional placement method of reinforcing strips for constructing a precast concrete facing panel, that is, construction difficulties and deformation arising after completing the placement. Therefore, it is an object of the present invention to provide a method of placing reinforcing strips, by which a pulling-up work of the reinforcing strips can be performed with an appropriate tension to prevent deformation of the reinforcing strips from occurring after completing the placement and to prevent the loosening of a concrete facing panel, and which can be performed faster, more easily and accurately.

It is another object of the present invention to provide a pulling-up device of a reinforcing strips, which is suitable for the above-described placement method and which can pull up the reinforcing strips more easily and faster.

To accomplish the first object of the present invention, there is provided a reinforcing strip placement method in a method of supporting a facing panel by zigzag-connecting synthetic resin reinforcing strips between fixing hookers formed on the interior surface of a concrete facing panel and a fixing iron bar fixed at the rear of a reinforcing soil member by means of an anchor, and burying the reinforcing strips into the reinforcing soil member at the rear of the concrete facing panel, the reinforcing strip placement method wherein a pulling-up device is locked between a rear end of the reinforcing strips and the fixing iron bar fixed by means of the anchor and pulled sequentially from one end to the other end of each of the reinforcing strips zigzag-connected between the concrete facing panel and the fixing iron bar, thereby preventing loosening of the reinforcing strips and applying a constant tension thereto, and then the reinforcing soil member is laid on the resultant structure and hardened by applying vibration and pressure thereto.

In an embodiment of the present invention, there is provided reinforcing strip pulling-up device having a gripper for gripping a reinforcing strip, a wire grip for pulling up the reinforcing strip gripped by the gripper, and a fixing hook connected to a rear end of the wire grip to be hooked to a temporarily fixing iron bar on the ground or at the rear end of a reinforcing soil member, wherein the gripper comprises a base on which the reinforcing strip is placed, a lateral plate extending upward at one side of the base, a support shaft fixed to the lateral plate to be parallel to the base, an eccentric roller allowing the reinforcing strip to be placed on the base to be inserted thereinto and gripped while being eccentrically fitted into the support shaft and rotating, and a connecting plate formed at one side of the lateral plate and having a rear end fixed to the leading edge of a tensiometer connected to the wire grip.

In the present invention, connection holes for selective installation of the connecting plate are preferably formed at the front and rear sides of the lateral plate.

Also, at least two of the base, the lateral plate and the connecting plate are preferably integrally formed with each other. Alternatively, while the base and the lateral plate are integrally fabricated, only the connecting plate may be separately fabricated and assembled by means of a bolt. Otherwise, while only the base is separately fabricated, the lateral plate and the connecting plate may be integrally fabricated, and the base, the lateral plate and the connecting plate can be assembled to one another by means of bolts.

Further, since the lower portions of the front and rear surfaces of the base and the lateral plane move back and forth in a state in which they are in contact with the ground of the reinforcing soil member, chamfer planes for reducing resistance against the ground and avoiding user's damage may be formed at the lower portions of the front and rear sides of the base. The surface of the eccentric roller is embossed to increase the friction between the surface of the eccentric roller and the surface of the reinforcing strip.

In another embodiment of the present invention, there is provided a reinforcing strip pulling-up device having a gripper for gripping a reinforcing strip, a wire grip for pulling up the reinforcing strip gripped by the gripper, and a fixing hook connected to a rear end of the wire grip to be hooked to a temporarily fixing iron bar on the ground or at the rear end of a reinforcing soil member, the improvement comprising a tensiometer configured such that the strength of tension applied to a reinforcing strip is confirmed by naked eye, the tension applied when the reinforcing strip is pulled by manipulating the wire grip in a state in which the reinforcing strip is gripped by the gripper such that the tensiometer is connected between the fixing hook and the wire grip, and an auxiliary lever bent or unbent at right angle at a lever for manipulating the wire grip, for pulling a wire of the wire grip by rotating the lever in a state in which the lever is laid down or by repeatedly moving the lever back and forth.

In a still another embodiment of the present invention, there is provided reinforcing strip pulling-up device having a gripper for gripping a reinforcing strip, a wire grip for pulling up the reinforcing strip gripped by the gripper, and a fixing hook connected to a rear end of the wire grip to be hooked to a temporarily fixing iron bar on the ground or at the rear end of a reinforcing soil member, wherein the wire grip includes a pair of levers at the right and left sides thereof so as to pull up a wire of the wire grip while manipulating the levers by both hands back and forth.

BEST MODE FOR CARRYING OUT THE INVENTION

Figure 1:
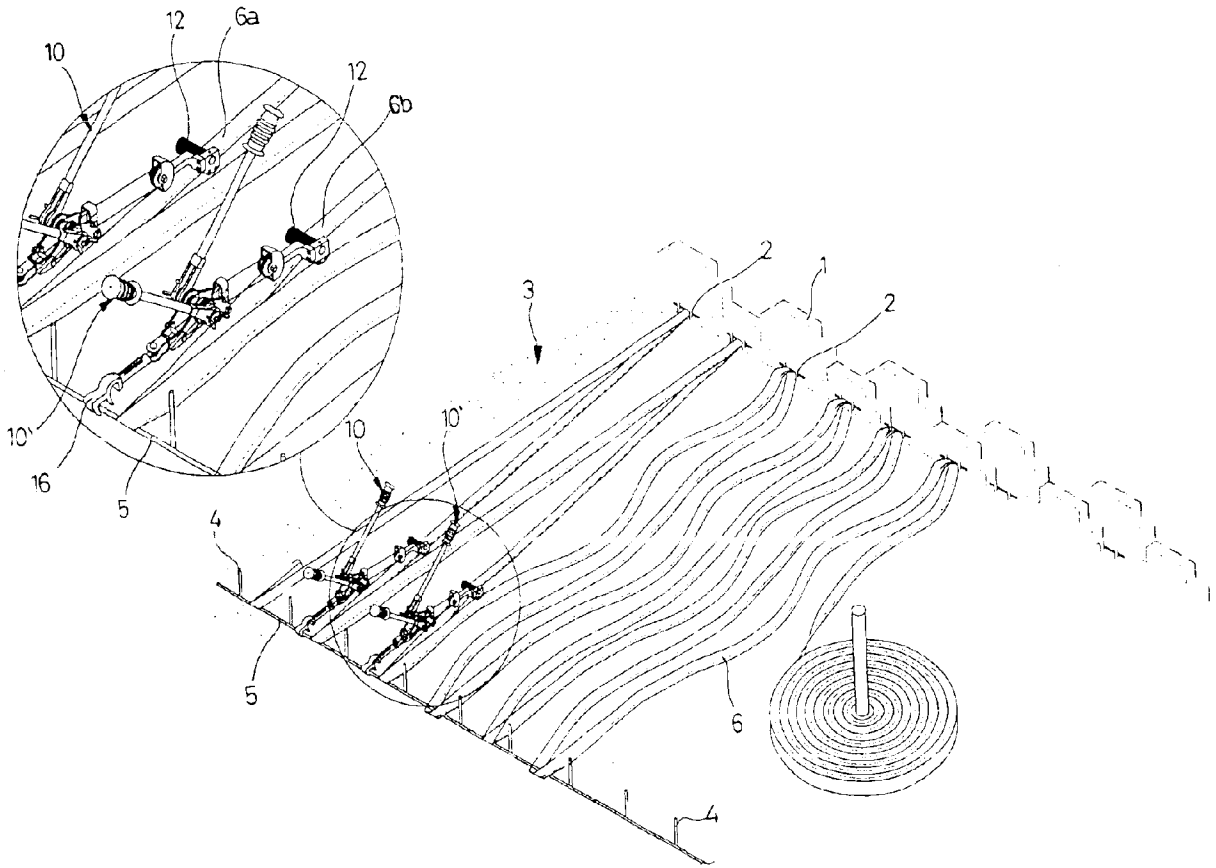
FIG. 1 is a perspective view of a placement method of reinforcing strips according to the present invention.

As shown in FIG. 1, a reinforcing strip placement method according to the present invention is directed to a method of supporting a facing panel by zigzag-connecting synthetic resin reinforcing strips 6 between fixing hookers 2 formed on the interior surface of a concrete facing panel 1 and a fixing iron bar 5 fixed at the rear of a reinforcing soil member 3 by means of an anchor 4, and burying the reinforcing strips 6 into the reinforcing soil member 3 at the rear of the concrete facing panel 1, wherein a pulling-up device 10 is locked between a rear end 6*a* of the reinforcing strips 6 and the fixing iron bar 5 fixed by means of the anchor 4 and pulled sequentially from one end to the other end of each of the reinforcing strips 6 zigzag-connected between the concrete facing panel 1 and the fixing iron bar 5, thereby preventing loosening of the reinforcing strips 6 and applying a constant tension thereto. Then, the reinforcing soil member 3 is laid on the resultant structure and hardened by applying vibration and pressure thereto.

In the reinforcing strip placement method according to the present invention, a worker can pull up the reinforcing strips using a single pulling-up device sequentially from a rear end of each of the reinforcing strips. Preferably, as shown in FIG. 1, two workers can perform a pulling-up work such that, in a state in which pulling-up devices 10 and 10' are locked to the reinforcing strips 6 at rear ends thereof, one worker completes the pulling-up work at the first line, and the other worker performs the pulling-up work at the second line with the pulling-up device 10 locked to the reinforcing strips 6. Thus, it is possible to effectively prevent the reinforcing strips from being pushed away reversely at bent portions of the concrete facing panel 1 and fixing iron bar 5, by a restoring force of the reinforcing strips 6 themselves. Also, since two workers alternately perform the pulling-up work, the working speed can be enhanced.

According to the reinforcing strip placement method of the present invention, when the pulling-up work for the second line is completed, the pulling-up device 10 for the first line is removed and then shifted to the third line to be locked while the pulling-up device 10' for the second line is retained at a locked state. This work is continuously repeated, thereby completing a sequence of installation and pulling-up works of the reinforcing strips.

FIGS. 2 through 5A show a reinforcing strip pulling-up device according to an embodiment of the present invention. In this embodiment, the pulling-up device includes a gripper 100 for gripping a reinforcing strip, a wire grip 200 for pulling up the reinforcing strip gripped by the gripper 100, and a fixing hook 300 connected to a rear end of the wire grip 200 to be hooked to a temporarily fixing iron bar on the ground or at the rear end of a reinforcing soil member. The gripper 100 includes a base 110 on which the reinforcing strip is placed, a lateral plate extending upward at one side of the base 110, a support shaft 130 fixed to the lateral plate 120 to be parallel to the base 110, an eccentric roller 140 allowing the reinforcing strip to be placed on the base 110 to be inserted thereinto and gripped while being eccentrically fitted into the support shaft 130 and rotating, and a connecting plate 160 formed at one side of the lateral plate 120 and having a rear end fixed to the leading edge of a tensiometer 150 connected to the wire grip 200.

In this embodiment, the gripper 100 is constructed such that the base 110, the lateral plate 120 and the connecting plate 160 are separately fabricated and then integrally connected to one another by means of bolts 170 and 172. Otherwise, the base 110, the lateral plate 120 and the connecting plate 160 may be integrally fabricated. Alternatively, while the base 110 and the lateral plate 120 are integrally fabricated, only the connecting plate 160 may be separately fabricated and assembled by means of a bolt. Otherwise, while only the base 110 is separately fabricated, the lateral plate 120 and the connecting plate 160 may be integrally fabricated, and the base 110, the lateral plate 120 and the connecting plate 160 can be assembled to one another.

A top plane 112 of the base 110 is planar so that the reinforcing strip placed thereon becomes slidable, and chamfer planes 114 and 116 for reducing resistance against the ground are formed at the lower portions of the front and rear sides of the base 110. A female screw hole (not shown) for bolt connection with the lateral plate 120 is formed at the lateral surface of the base 110.

Connection holes 122 for bolt connection with the base 110 are formed through at the lower portion of the lateral plate 120. A shaft fixing hole 126 into which one end of the support shaft 130 is inserted, to be fixed by a set screw 124, is formed at the upper portion of the lateral plate 120. Connection holes 128 for selective installation of the connecting plate 160 are formed at the front and rear sides of the lateral plate 120. In such a manner, the connecting plate 160 can be fixed on the front or rear surface of the lateral plate 120 such that the reinforcing strip can be pushed away left or right according to user's preference or conditions of a construction site where the pulling-up device is to be used.

Figure 5A:
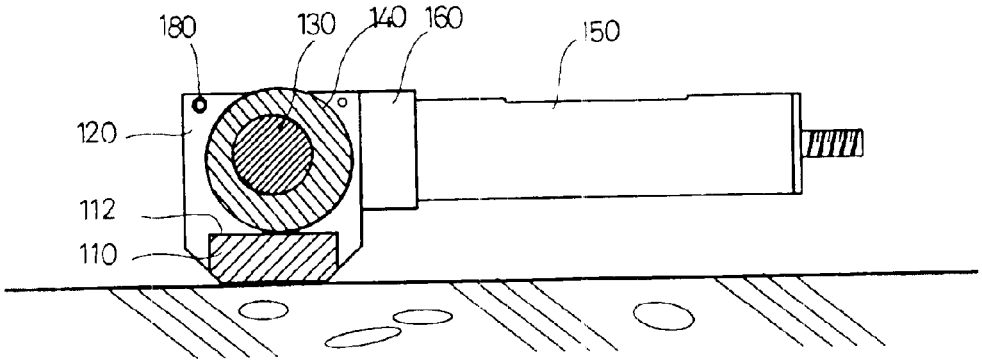
FIG. 5A is a cross-sectional view showing essential parts of the gripper.
Figure 5B:
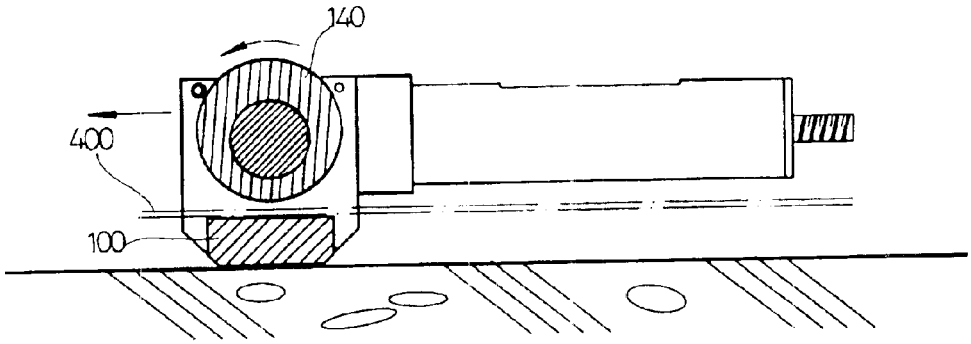
FIG. 5B is a cross-sectional view showing a state in which a reinforcing strip is inserted into the gripper to be locked.
Figure 5C:
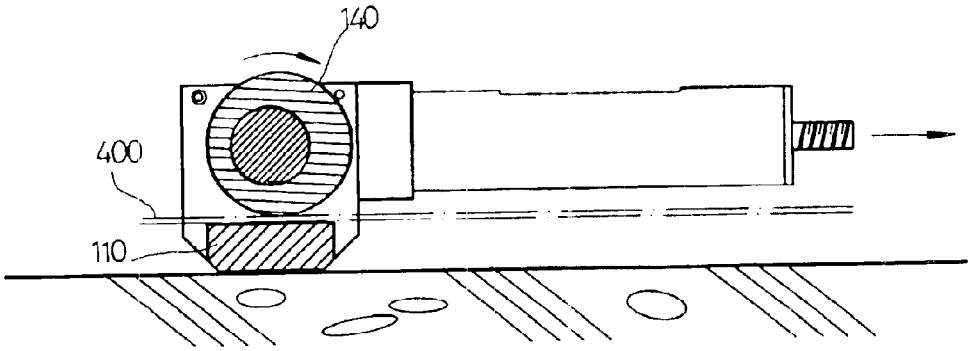
FIG. 5C is a cross-sectional view showing a state in which a reinforcing strip is locked with the gripper after being inserted into the gripper.

The eccentric roller 140 inserted into the support shaft 130 is formed with eccentricity, that is, in such a manner that the center of an internal shaft hole 142 deviates from the center of the outer diameter of the eccentric roller 140. Thus, if the eccentric roller 140 rotates in a state in which it is inserted into the support shaft 130, the gap between the eccentric roller 140 and the top plane 112 of the base 110 becomes narrower or wider. That is, as shown in FIG. 5A, in a state in which the eccentric roller 140 is inserted into the support shaft 130, a portion where the load of the eccentric roller 140 is heavy, i.e., a thicker portion of the eccentric roller 140, moves downward, and a relatively thinner portion of the eccentric roller 140 is positioned upward. Thus, as shown in FIG. 5B, if a reinforcing strip 400 is inserted between the top plane 112 of the base 110 and the eccentric roller 140 from the front to the rear of the gripper 100, as shown in FIG. 5B, the eccentric roller 140 rotates counterclockwise and the gap between the top plane 112 of the base 110 and the eccentric roller 140 is increased so that the reinforcing strip 400 is inserted into the gap. On the contrary, as shown in FIG. 5C, if the gripper 100 is pulled rearward, the eccentric roller 140 rotating counterclockwise rotates clockwise by friction against the reinforcing strip 400 and its own load and the gap between the top plane 112 of the base 110 and the eccentric roller 140 is decreased so that the reinforcing strip 400 is securely gripped.

In order to increase the friction between the surface of the eccentric roller 140 and the surface of the reinforcing strip 400, the surface of the eccentric roller 140 is embossed.

Referring back to FIG. 4, a set screw 144 for preventing the eccentric roller 140 from arbitrarily deviating by being inserted into the support shaft 130, is also provided at the eccentric roller 140. A front end of the set screw 144 is inserted into a deviation preventing groove 132 formed along the periphery of the support shaft 130 so that the eccentric roller 140 rotates while preventing the eccentric roller 140 from deviating from the support shaft 130.

The tensiometer 150 is configured such that the strength of tension applied to the reinforcing strip can be confirmed by naked eye, the tension applied when the reinforcing strip is pulled by manipulating the wire grip 200 in a state in which the reinforcing strip is gripped by the gripper 100 such that a male screw 152 of its front end is connected to a female screw hole 162 of the connecting plate 160 and a male screw 154 of its rear end is connected to the wire grip 200, and includes a compression spring.

Figure 4:
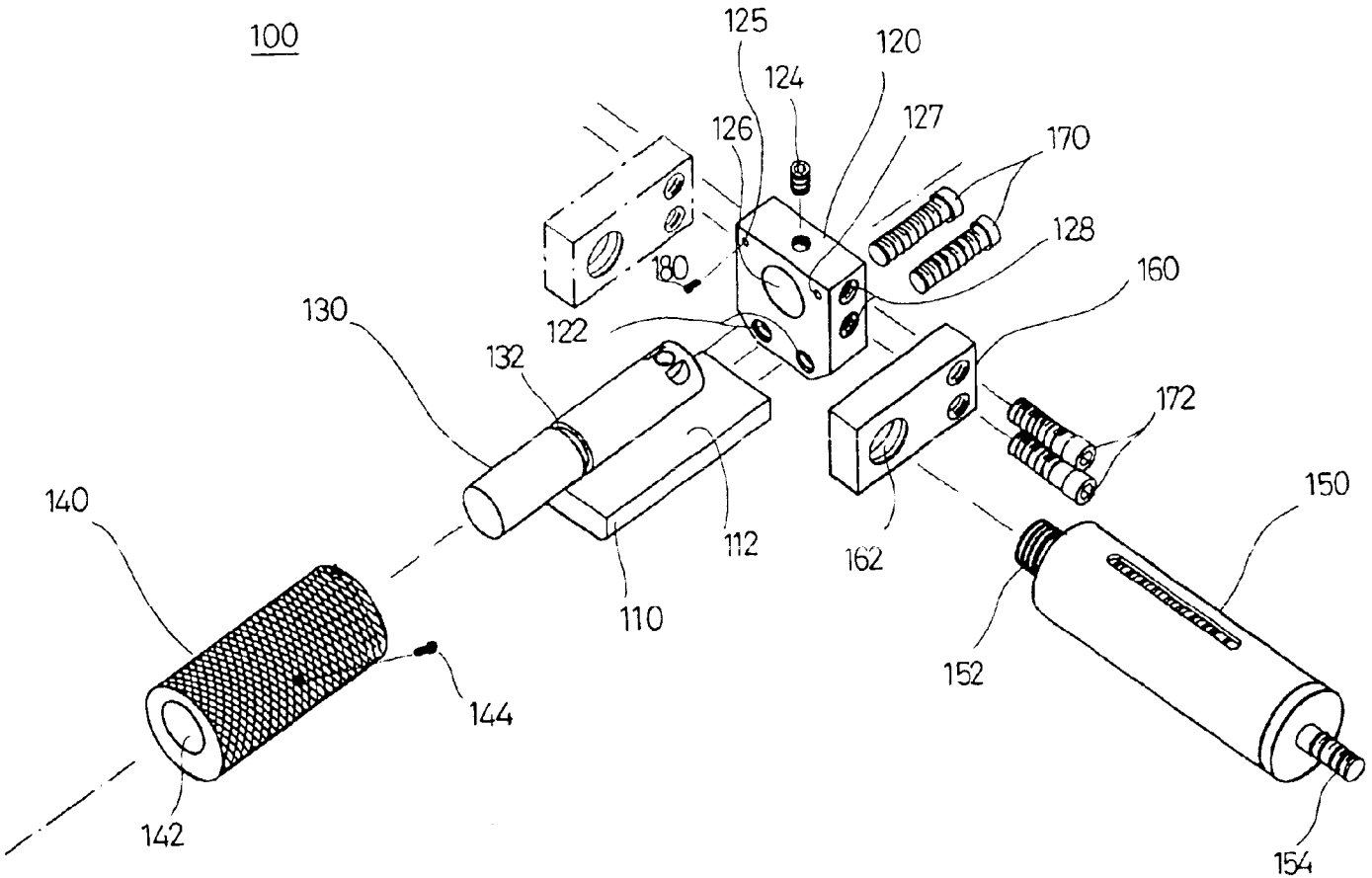
FIG. 4 is an exploded perspective view of the gripper of the pulling-up device shown in FIG. 2.

Holes 125 and 127 for selectively installing a stopper 180 are formed at the front and rear of the upper portion of the lateral plate 120. The stopper 180 for preventing the eccentric roller 140 from excessively rotating, is in contact with a outer portions of the eccentric roller 140 and controls unidirectional rotation of the eccentric roller 140, as shown in FIG. 4.

Figure 2:
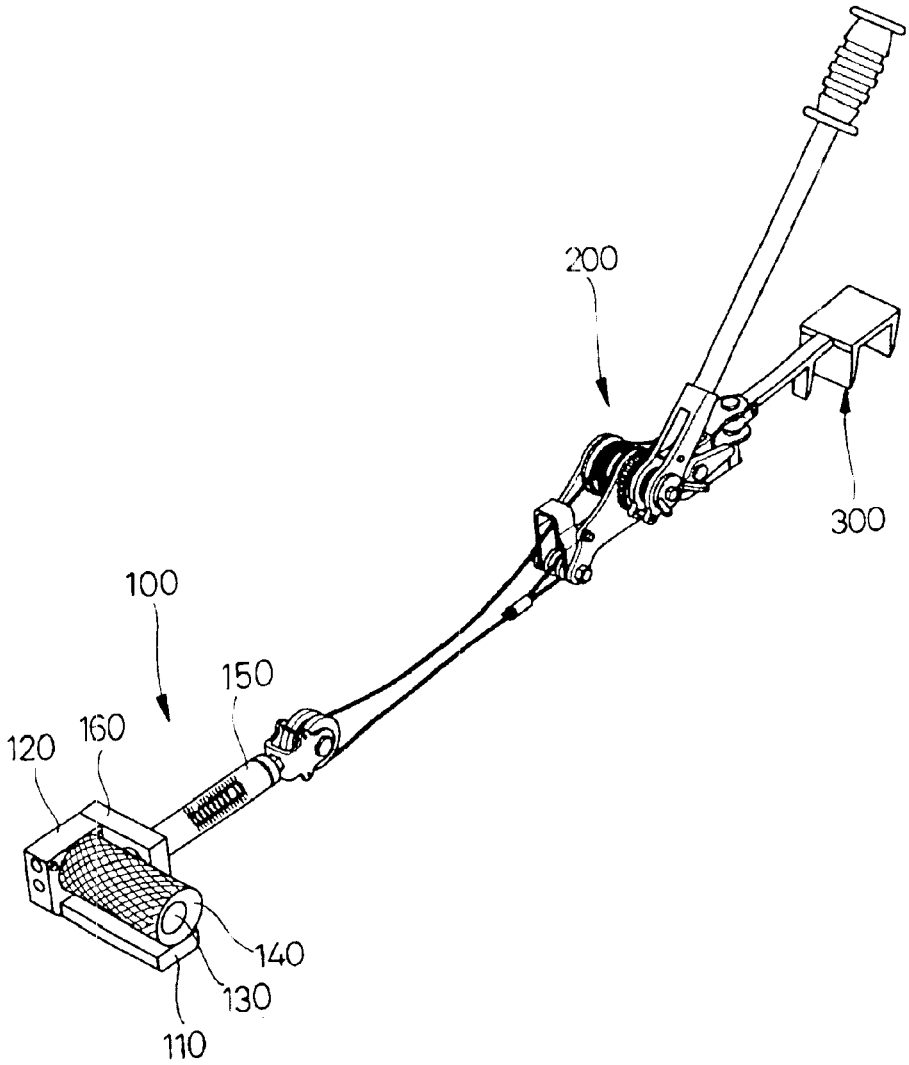
FIG. 2 is an overall perspective view of a pulling-up device of reinforcing strips for supporting a concrete facing panel according to an embodiment of the present invention.
Figure 3:
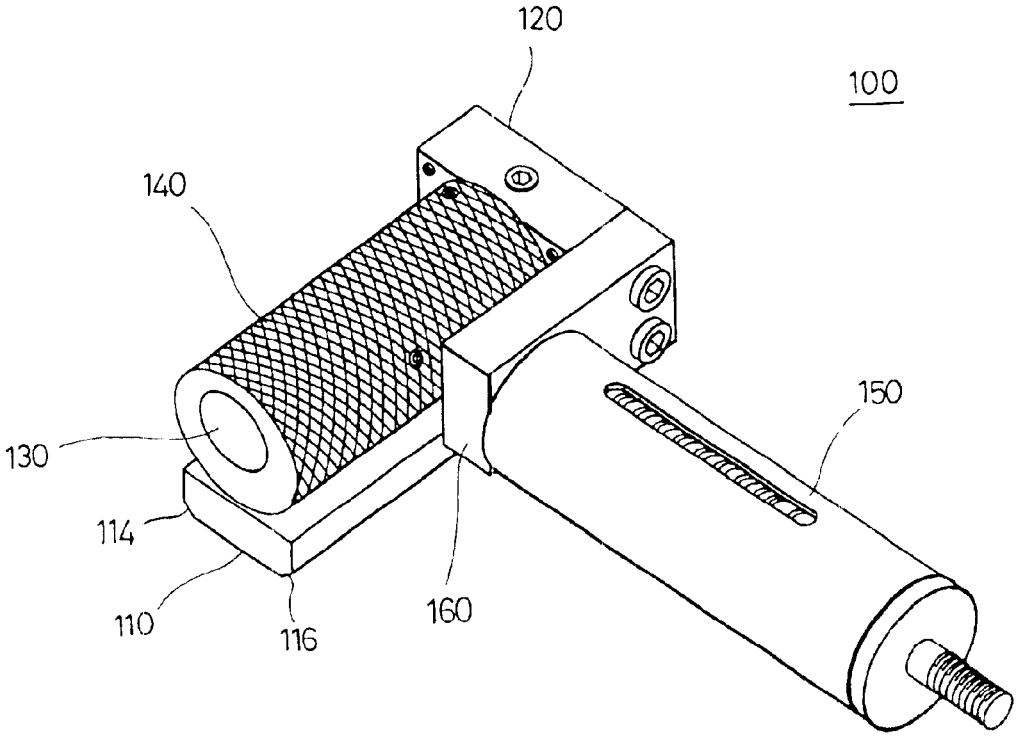
FIG. 3 is a perspective view of a gripper of the pulling-up device shown in FIG. 2.
Figure 6:
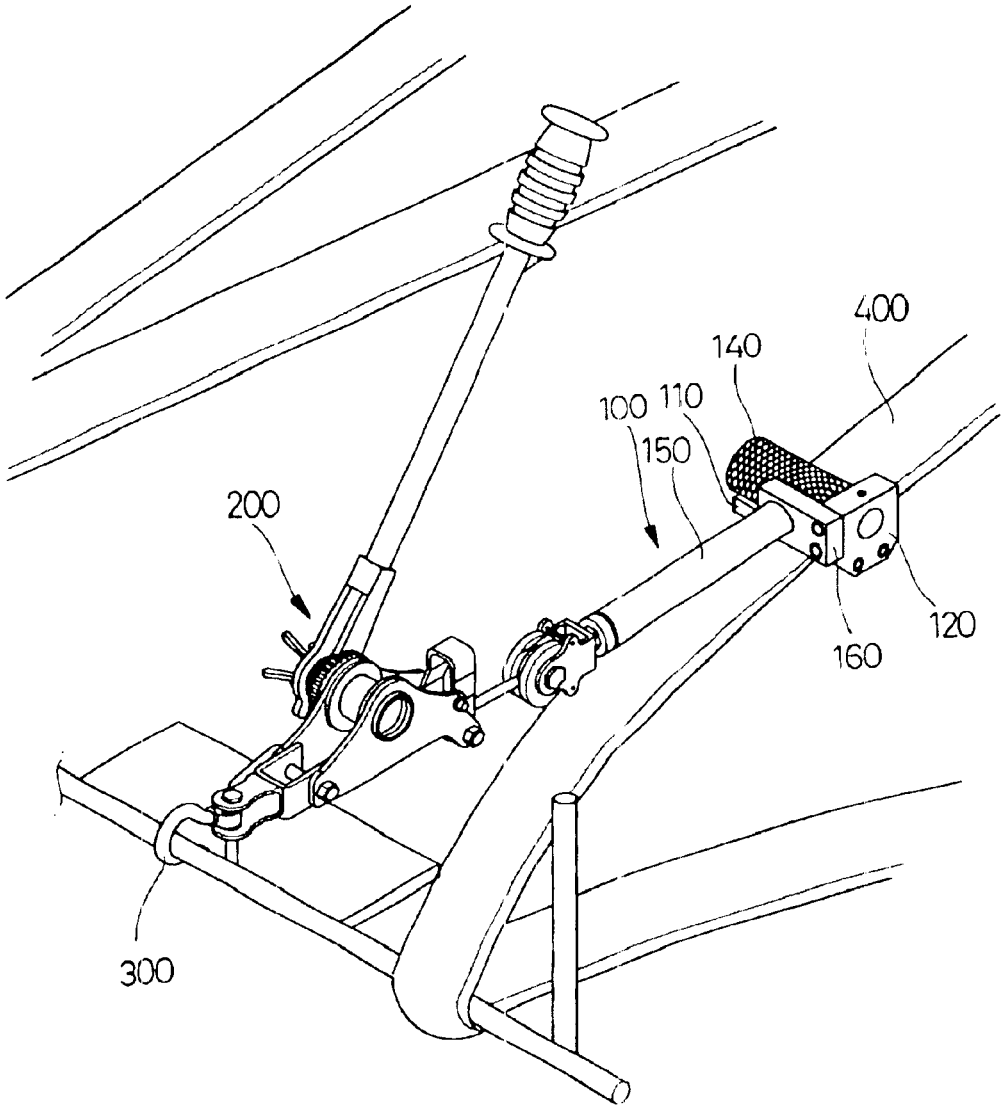
FIG. 6 is a perspective view showing a use state of the pulling-up device shown in FIG. 2.

FIG. 6 is a perspective view showing a use state of the pulling-up device shown in FIG. 2, in which a fixing hook 300 of a typical type is employed. An explanation of manipulation of the wire grip 200 and hooking the fixing hook 300 to the ground or the temporarily fixing iron bar will not be given herein.

In the present invention, the gripper 100 for gripping the reinforcing strip 400 consists of the base 110 provided at the lower portion thereof and the eccentric roller 140 provided at the upper portion thereof, and the reinforcing strip 400 is horizontally gripped therebetween. Thus, there is no warp of the reinforcing strip at a gripped portion by gripping and pulling-up the reinforcing strip in a state in which the reinforcing strip is spread over the reinforcing soil member. If the pulling-up work is completed, the reinforcing strip is not loosened, thereby achieving more accurate placement. Also, the reinforcing strip 400 can be inserted between the base 110 and the eccentric roller 140 just by advancing the gripper 100 therebetween, and the reinforcing strip 400 can be gripped just by retracting the gripper 100. Thus, it is not necessary to apply press or remove pressure using a pressing handle, unlike in the prior art, or to manipulate a gap adjusting device for adjusting an appropriate gap, thereby performing the gripping work more easily and fast. Also, the gripper 100 can be miniaturized, and can be simplified, thereby attaining better manageability thereof.

Figure 7:
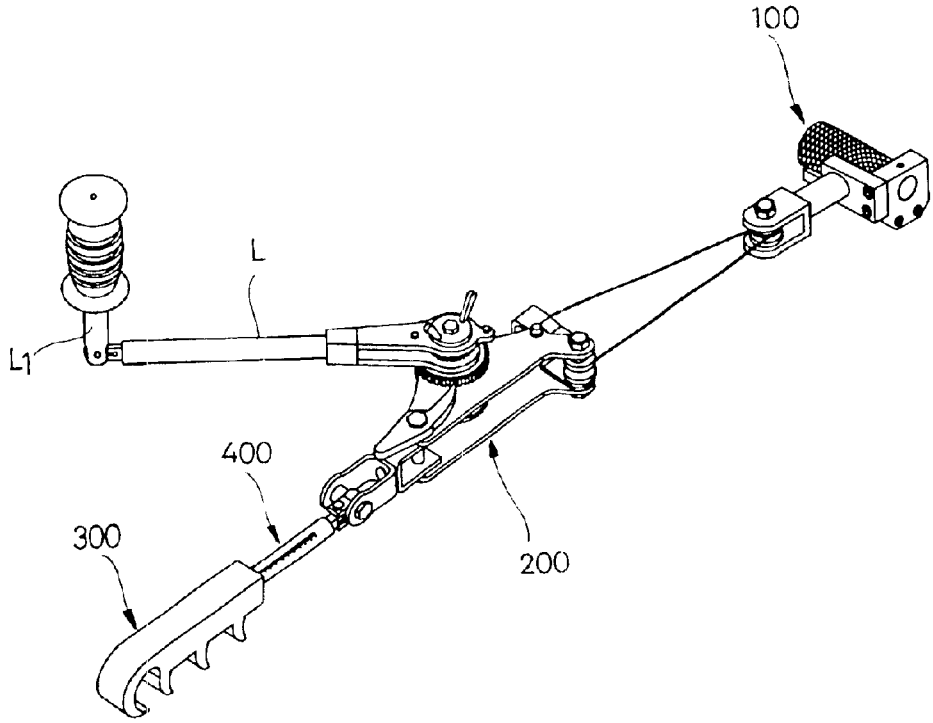
FIG. 7 is a perspective view showing a pulling-up device according to another embodiment of the present invention.

FIG. 7 is a perspective view showing a pulling-up device according to another embodiment of the present invention. The pulling-up device having a gripper 100 for gripping a reinforcing strip, a wire grip 200 for pulling up the reinforcing strip gripped by the gripper 100 and a fixing hook 300 connected to a rear end of the wire grip 200 to be hooked to a temporarily fixing iron bar on the ground or at the rear end of the reinforcing soil member, includes a tensiometer 450 configured such that the strength of tension applied to a reinforcing strip can be confirmed by naked eye, the tension applied when the reinforcing strip is pulled by manipulating the wire grip 200 in a state in which the reinforcing strip is gripped by the gripper 100 such that the tensiometer 450 is integrally formed with the fixing hook 300 and is connected with the wire grip 200, and an auxiliary lever L1 bent or unbent at right angle at a lever L for manipulating the wire grip 200, for pulling a wire of the wire grip 200 by rotating the lever L in a state in which the lever L is laid down or by repeatedly moving the lever back and forth.

Figure 8:
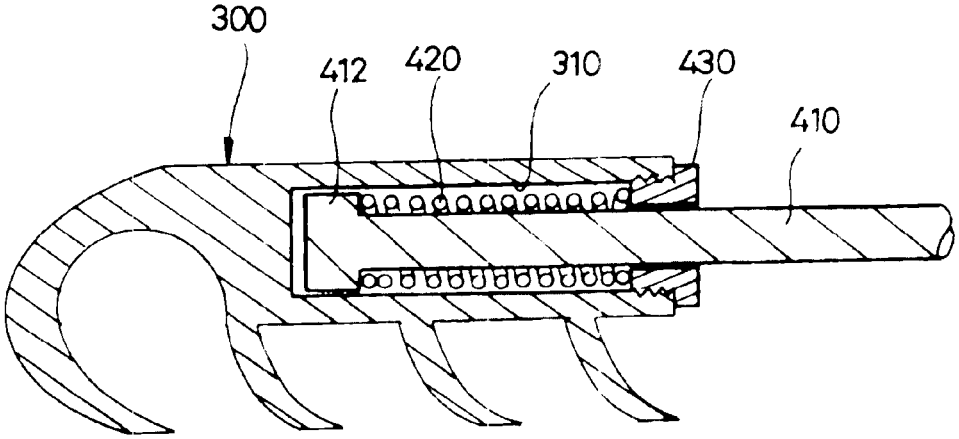
FIG. 8 is a cross-sectional view of a tensiometer mounted fixing hook shown in FIG. 7.

FIG. 8 is a cross-sectional view of a tensiometer mounted fixing hook shown in FIG. 7, in which a rear end of a tensiometer bar 410 is inserted into an installation space 310 inside the fixing hook 300, a flange 412 contacting the rear end of a compression spring 420 is formed at the rear end of the tensiometer bar 410, and the front end of the compression spring 420 securely contacts the inside of a cap 430 fitted to the front end of the installation space 310. The tensiometer bar 410 has graduations marked thereon so that the current tensile force can be confirmed by naked eye by checking graduations marked on a portion exposed to the outside of the fixing hook 300 by manipulating the wire grip 200.

Figure 9:
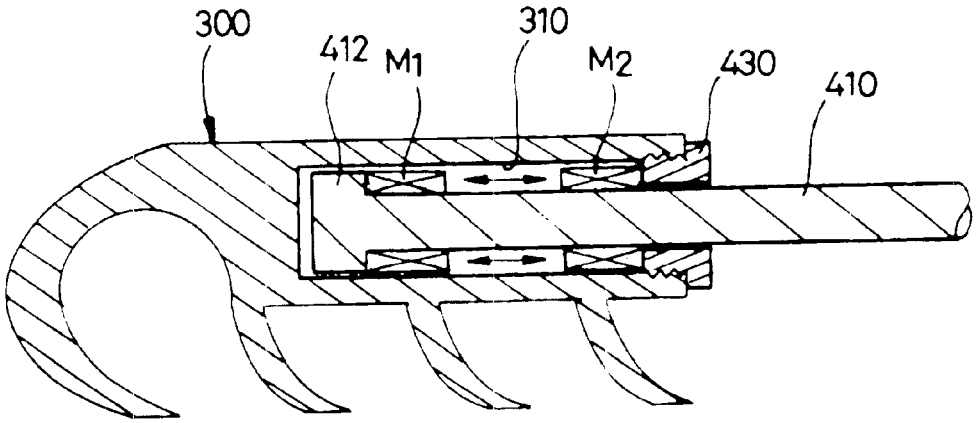
FIG. 9 is a cross-sectional view of a tensiometer mounted fixing hook according to still another embodiment of the present invention.

FIG. 9 is a cross-sectional view of a tensiometer mounted fixing hook according to still another embodiment of the present invention. In this embodiment, strong permanent magnets M1 and M2 are installed at opposite sides between the flange 412 and the cap 430 positioned at the rear of the tensiometer bar 410 to generate a repulsive force, instead of the compression spring 420 shown in FIG. 8, and the tensiometer bar 410 is pulled outward by overcoming the repulsive force between the permanent magnets M1 and M2 when the wire grip 200 is manipulated.

Figure 10:
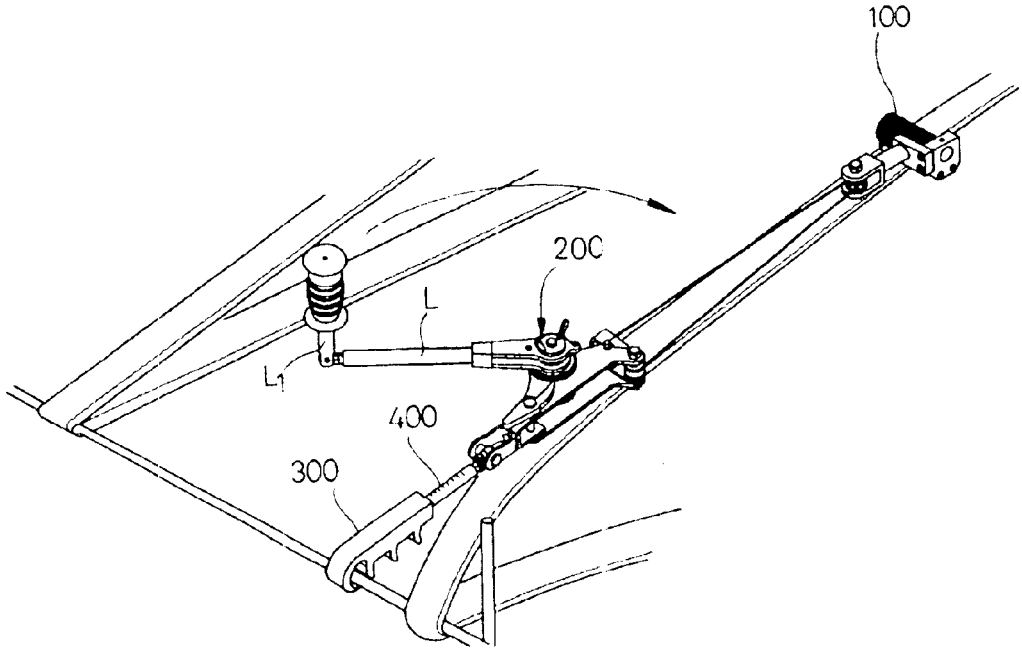
FIG. 10 is a perspective view showing an initial use state in the embodiment shown in FIG. 9.
Figure 11:
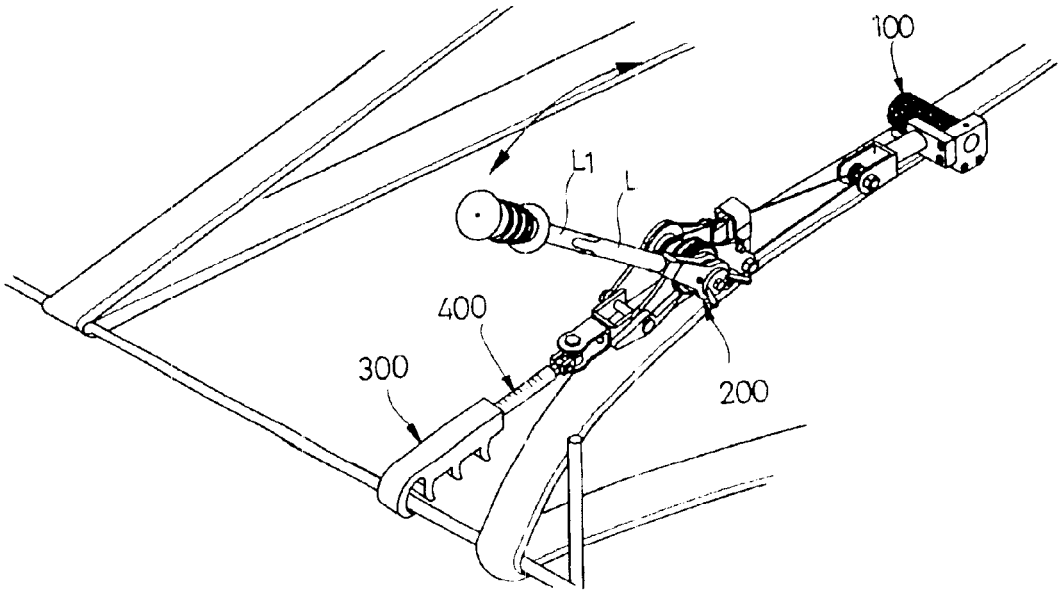
FIG. 11 is a perspective view showing a later use state in the embodiment shown in FIG. 9.

The above-described construction according to the present invention is used in such manners as shown in FIGS. 10 and 11. During an initial stage for pulling up a reinforcing strip, as shown in FIG. 10, in a state in which the wire grip 200 is lied down and the lever L of the wire grip 200 is also lied down, if the auxiliary lever L1 is allowed to erect perpendicularly to rotate the lever L in one direction just like manipulation of a general rotation handle, the wire grip 200 is rotated, thereby pulling up the wire fast at once.

In the above-described manipulating process, the tension applied to the wire is not so strong. Thus, the lever L rotates easily. If a greater force is applied as the number of rotations of the lever L increases, the reinforcing strip can be tightly pulled as the wire is pulled by manipulating the lever L back and forth, in a state in which the wire grip 200 is allowed to stand so as to make the lever L stand accordingly and the auxiliary lever L1 is aligned with the lever L, as shown in FIG. 11. Then, after adjusting an appropriate tension while observing graduations of the tensiometer 450, the reinforcing strip fixing work is performed.

In this embodiment, since the tensiometer 450 is integrally formed with the fixing hook 300 and is positioned at the rear of the wire grip 200, the tension applied to the reinforcing strip can be easily observed by worker's naked eye just by looking down while the worker manipulates the lever L.

Figure 12:
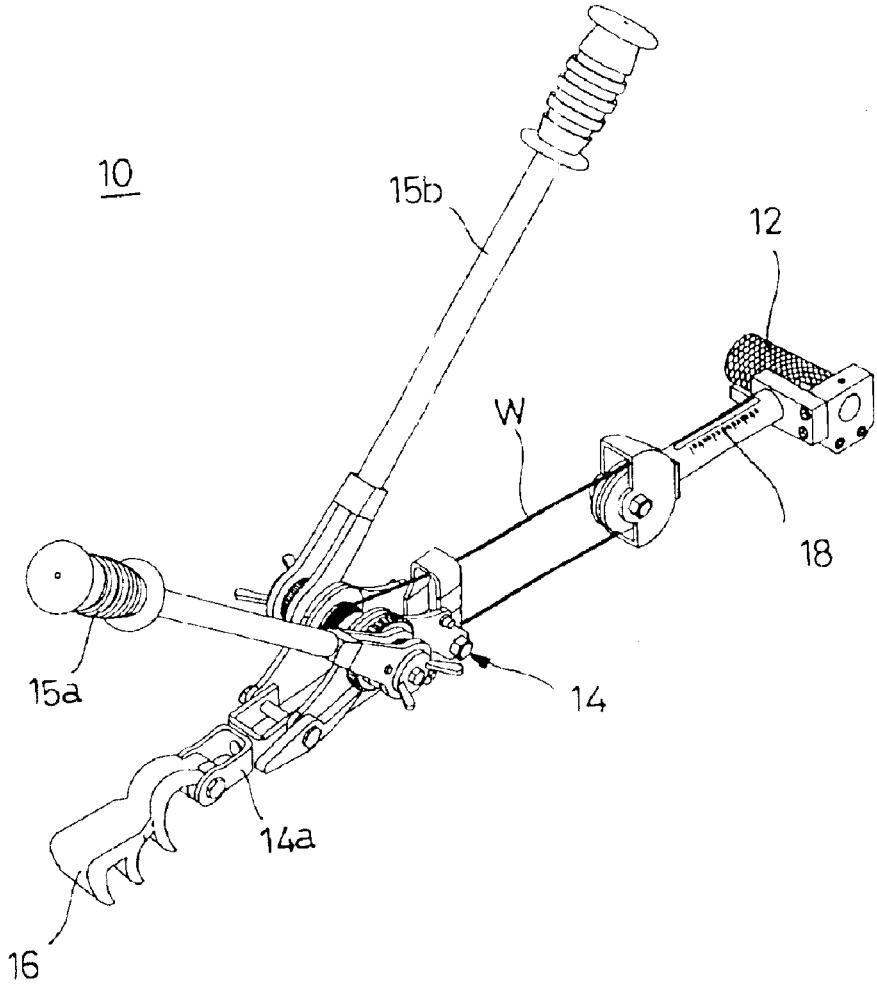
FIG. 12 is a perspective view showing a pulling-up device according to still another embodiment of the present invention.

FIG. 12 is a perspective view showing a pulling-up device according to still another embodiment of the present invention. A pulling-up device 10 according to this embodiment includes a gripper 12 for gripping a reinforcing strip, a wire grip 14 for pulling up the reinforcing strip gripped by the gripper 12, and a fixing hook 16 connected to the rear end of the wire grip 14, for hooking the wire grip 14 to the ground or a fixing iron bar at the rear end of a reinforcing soil member. The wire grip 14 includes a pair of levers 15*a* and 15*b* at the right and left sides thereof so as to pull up a wire W of the wire grip 14 while manipulating the levers 15*a* and 15*b* by both hands back and forth, thereby pulling up the reinforcing strip more efficiently.

In other words, the pulling-up device according to this embodiment includes the levers 15*a* and 15*b* provided at both sides of the wire grip 14 to be alternately driven, thereby pulling up the wire two times faster than the conventional wire grip in which only a lever is provided and only one hand is used in manipulating the wire grip.

As shown in FIG. 12, the pulling-up device according to the present invention has the tensiometer 18 between the gripper 12 and the wire grip 14 so that the tension applied to the reinforcing strip when pulling the reinforcing strip can be confirmed by naked eye while observing the tensiometer 18, thereby performing a reinforcing strip pulling-up work with a constant tension. Accordingly, deformation of a concrete facing panel, which may occur due to a nonuniform pulling-up work of the reinforcing strip after completing the placement, can be prevented.

Figure 13:
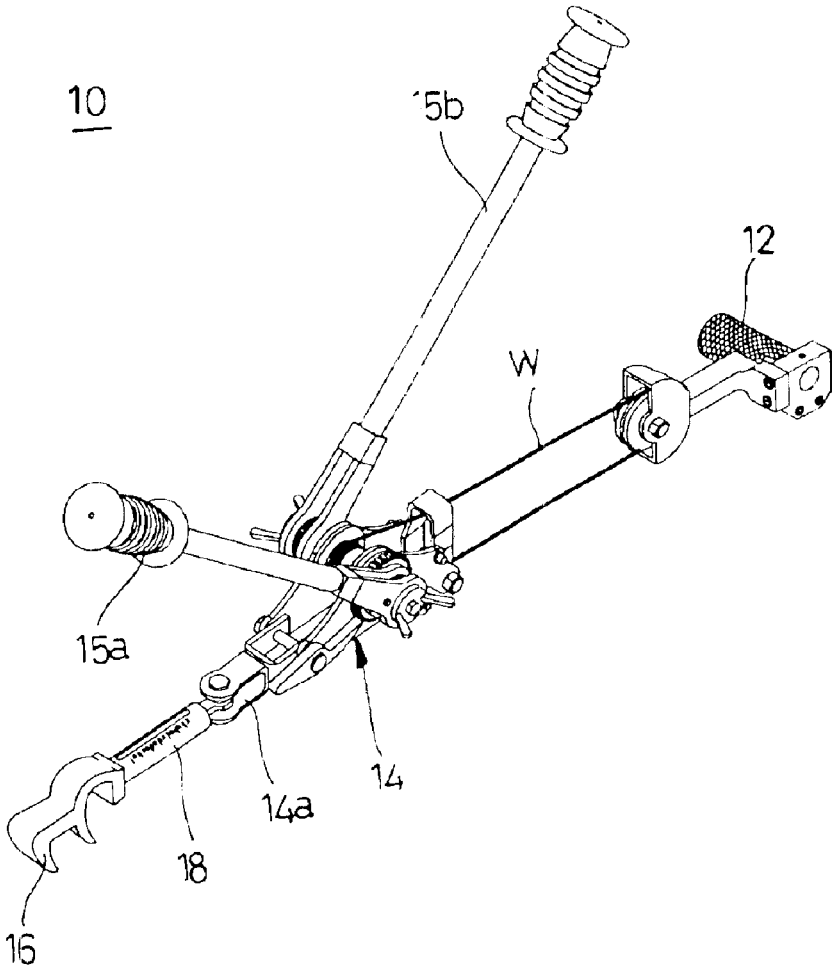
FIG. 13 is a perspective view showing a pulling-up device according to still another embodiment of the present invention.

FIG. 13 is a perspective view showing a pulling-up device according to still another embodiment of the present invention, in which a tensiometer 18 is integrally formed with a fixing hook 16 provided at the rear end of the pulling-up device 10, and the front end of the tensiometer 18 is connected to a crevice 14*a* of a wire grip 14. Since the tensiometer 18 is installed at the rear end of the pulling-up device 10, a pulling-up worker can observe graduations on the tensiometer 18 more easily by naked eye at a lever manipulation position.

According to the present invention, in the process of pulling up a reinforcing strip, the pulling-up work can be done by a single worker using the present invention pulling-up device. Also, since the pulling-up device is manipulated in a state in which it is locked between the rear end of the reinforcing strip and a fixing iron bar, construction of the reinforcing strip can be completed even at a construction site where obstacles such as rock or other pre-installed construction exist at the rear of a reinforcing soil member, without any difficulty.

Further, since a pair of levers are provided at the pulling-up device according to the present invention, a worker can manipulate the levers by both hands, thereby completing the pulling-up work more rapidly. Also, since the pulled state of the reinforcing strip is adjusted constantly while observing a tensiometer, deformation of a concrete facing panel, which may occur due to a nonuniform pulling-up work of the reinforcing strip after hardening a reinforcing soil member, can be prevented.

In contrast with the conventional technology in which a worker must pull up a reinforcing strip with the reinforcing strip gripped with a hand, according to the present invention, a worker has only to pull up the lever of a wire grip with a reinforcing strip gripped by a gripper, thereby reducing the worker's physical fatigue and greatly reducing a construction period and labor force.

As described above, according to the present invention, unlike in the prior art in which the construction work is only affected by labor force, a pulling-up device is employed for constructing a precast concrete facing panel, thereby performing a pulling-up work rapidly with a constant tension, leading to accurate construction. Also, a reduction in labor force and a shortened construction period can be achieved. That is, a concrete facing panel can be more effectively constructed, compared to the conventional concrete facing panel.

INDUSTRIAL APPLICABILITY

According to the present invention, when a reinforcing strip is installed at the rear of a concrete facing panel in a zigzag pattern, a pulling-up work can be performed faster, more easily and more accurately with a constant tension, without loosening of a reinforcing strip, thereby improving the working efficiency and accuracy in constructing a precast concrete facing panel. Also, since initial elongation of a reinforcing strip can be controlled initially by a mechanical force of a pulling-up device, initial deformation of the reinforcing strip itself and deformation of the concrete facing panel, which may occur after completing the placement due to a nonuniform pulling-up work of the reinforcing strip, can be prevented.

What is claimed is:

1. A reinforcing strip placement method of supporting a facing panel by zigzag-connecting synthetic resin reinforcing strip between fixing hookers formed on the interior surface of a concrete facing panel and a fixing iron bar fixed at the rear of a reinforcing soil member by means of an anchor, and burying the reinforcing strips into the reinforcing soil member at the rear of the concrete facing panel, the reinforcing strip placement method comprising:

locking a pulling up device between a rear end of the reinforcing strips and the fixing iron bar fixed by the anchor and pulling sequentially from one end to the other end of each of the reinforcing strips zigzag-connected between the concrete facing panel and the fixing iron bar, thereby preventing loosening of the reinforcing strips and applying a constant tension thereto; and laying the reinforcing soil member on the resultant structure and hardening the reinforcing soil member by applying vibration and pressure thereto, wherein the pulling up device includes a gripper for gripping a reinforcing strip, a wire grip for pulling up the reinforcing strip gripped by the gripper, and a fixing hook connected to a rear end of the wire grip to be hooked to a temporarily fixing iron bar on the around or at the rear end of a reinforcing soil member, and wherein the gripper includes a base on which the reinforcing strip is placed, a lateral plate extending upward at one side of the base, a support shaft fixed to the lateral plate to be parallel to the base, an eccentric roller allowing the reinforcing strip to be placed on the base to be inserted thereinto and gripped while being eccentrically fitted into the support shaft and rotating, and a connecting plate formed at one side of the lateral plate and having a rear end fixed to the leading edge of a tensiometer connected to the wire grip.

2. The method according to claim 1, wherein two workers perform a pulling-up work such that, in a state in which pulling-up devices are locked to the reinforcing strips at rear ends thereof, one worker completes the pulling-up work at the first line, and the other worker performs the pulling-up work at the second line with the pulling-up device locked to the reinforcing strips, and, when the pulling-up work for the second line is completed, the steps of removing the pulling-up device for the first line and then shifting the pulling-up device to the third line to be locked while the pulling-up device for the second line is retained at a locked state, are continuously repeated.

3. A reinforcing strip pulling-up device comprising:

a gripper for gripping a reinforcing strip;

a wire grip for pulling up the reinforcing strip gripped by the gripper; and a fixing hook connected to a rear end of the wire grip to be hooked to a temporarily fixing iron bar on the ground or at the rear end of a reinforcing soil member, wherein the gripper includes a base on which the reinforcing strip is placed, a lateral plate extending upward at one side of the base, a support shaft fixed to the lateral plate to be parallel to the base, an eccentric roller allowing the reinforcing strip to be placed on the base to be inserted thereinto and gripped while being eccentrically fitted into the support shaft and rotating, and a connecting plate formed at one side of the lateral plate and having a rear end fixed to the leading edge of a tensiometer connected to the wire grip.

4. The pulling-up device according to claim 3, wherein connection holes for selective installation of the connecting plate are formed at the front and rear sides of the lateral plate.

5. The pulling-up device according to claim 3, wherein at least two of the base, the lateral plate and the connecting plate are integrally formed with each other.

6. The pulling-up device according to claim 3, wherein chamfer planes for reducing resistance against the ground are formed at the lower portions of the front and rear sides of the base.

7. The pulling-up device according to claim 3, wherein the surface of the eccentric roller is embossed to increase the friction between the surface of the eccentric roller and the surface of the reinforcing strip.

8. A reinforcing strip pulling-up device having a gripper for gripping a reinforcing strip, a wire grip for pulling up the reinforcing strip gripped by the gripper, and a fixing hook connected to a rear end of the wire grip to be hooked to a temporarily fixing iron bar on the ground or at the rear end of a reinforcing soil member, comprising:

a tensiometer configured such that the strength of tension applied to a reinforcing strip is confirmed by naked eye, the tension applied when the reinforcing strip is pulled by manipulating the wire grip in a state in which the reinforcing strip is gripped by the gripper such that the tensiometer is connected between the fixing hook and the wire grip; and an auxiliary lever bent or unbent at right angle at a lever for manipulating the wire grip, for pulling a wire of the wire grip by rotating the lever in a state in which the lever is laid down or by repeatedly moving the lever back and forth.

9. The reinforcing strip pulling-device according to claim 8, wherein a rear end of a tensiometer bar is inserted into an installation space inside the fixing hook, a flange contacting the rear end of a compression spring is formed at the rear end of the tensiometer bar, and the front end of the compression spring securely contacts the inside of a cap fitted to the front end of the installation space, the tensiometer bar having graduations marked thereon.

10. The reinforcing strip pulling-device according to claim 8, wherein a rear end of a tensiometer bar is inserted into an installation space inside the fixing hook, a flange into which the rear end of a first permanent magnet is fitted is installed at the rear end of the tensiometer bar, and a second permanent magnet corresponding to the first permanent magnet is formed inside of a cap fitted to the front end of the installation space to generate a repulsive force, the tensiometer bar having graduations marked thereon.

11. A reinforcing strip pulling-up device comprising:

a gripper for gripping a reinforcing strip;

a wire grip for pulling up the reinforcing strip gripped by the gripper; and a fixing hook connected to a rear end of the wire grip to be hooked to a temporarily fixing iron bar on the ground or at the rear end of a reinforcing soil member, wherein the wire grip includes a pair of levers at the right and left sides thereof so as to pull up a wire of the wire grip while manipulating the levers by both hands back and forth.

12. The pulling-up device according to claim 11, wherein a tensiometer is installed to confirm the strength of tension applied to the reinforcing strip when the reinforcing strip is pulled, by naked eye.

* * * * *

UNITED STATES PATENT AND TRADEMARK OFFICE

CERTIFICATE OF CORRECTION

PATENT NO. : 6,848,674 B2
DATED : February 1, 2005
INVENTOR(S) : Jeung Su Lee

It is certified that error appears in the above-identified patent and that said Letters Patent is hereby corrected as shown below:

Column 9,
Line 40, change “strip” to -- strips --;
Line 63, change “around” to -- ground --.

Signed and Sealed this

Twelfth Day of July, 2005

JON W. DUDAS
*Director of the United States Patent and Trademark Office*